United States Patent [19]

De Rose

[11] Patent Number: 4,729,167

[45] Date of Patent: Mar. 8, 1988

[54] CUTTING TOOL FOR CARDBOARD BOXES

[76] Inventor: Peter De Rose, P.O. Box 5422, Albuquerque, N. Mex. 87185

[21] Appl. No.: 907,409

[22] Filed: Oct. 24, 1986

[51] Int. Cl.[4] ..... B67B 7/00

[52] U.S. Cl. ..... 30/2; 30/162; 30/335

[58] Field of Search ..... 30/2, 162, 335, 163, 30/336

[56] References Cited

U.S. PATENT DOCUMENTS

| | | | |
|---|---|---|---|
| 2,237,331 | 4/1941 | Bodkin et al. | 30/162 |
| 2,566,493 | 9/1951 | Ladd | 30/162 |
| 3,927,473 | 12/1975 | Braginetz | 30/162 X |
| 3,983,595 | 10/1976 | Knodsen et al. | 30/162 X |

*Primary Examiner*—Douglas D. Watts

*Attorney, Agent, or Firm*—Roland De Rose

[57] ABSTRACT

The device is a cutting tool for opening cardboard boxes and the like including a handle with rounded ends a blade slot and an adjustment opening. There is also provided a razor blade and an adjustment device to position the blade longitudinally within the blade slot.

1 Claim, 4 Drawing Figures

CUTTING TOOL FOR CARDBOARD BOXES

BACKGROUND OF THE INVENTION

This invention relates to cutting tools for cardboard boxes and more particularly it relates to a hand cutting tool that has a blade slidably mounted in the handle thereof for extension to a cutting position and retraction to a covered and protected position during nonuse of the tool.

It is essential for cardboard box cutting and opening operations that the cutting tool be equipped with a blade of some type that will cut open any size cardboard container. It has been found that current state-of-the-art tools, utilizing retractable razor blades as the cutting edge do not operate satisfactorily. Often when using tools of this type to open cardboard boxes the razor blade must either be removed from the tool and used alone for cutting; or the container to be opened must be maneuvered in such a way that pressure exerted on the razor blade can be transferred to the container without damaging the contents thereof. It is often not convenient or possible to maneuver a container around. Conventional cutting tools commonly include a mechanism that permits easy retraction of the blade into the tool handle so as to protect the user from the blade during nonuse of the tool. However, the mechanism that permits easy movement of the extension or retraction of the blade in the handle of conventional cutting tools of this type also allows the blade to move relatively to the handle during use. This does not occur with applicant's cutting tool which utilizes a more reliable mechanism for clamping the blade in an extended position or a retracted carrying position.

SUMMARY OF THE INVENTION

Briefly, the invention is a cutting tool having a handle made up of two side members with a single edged razor blade slidably mounted therebetween. The tool includes an adjusting means comprised of a screw, a guide means, and an adjusting washer having a threaded central opening that is employed to mount the blade in the handle and clamp it securely in an extended or retracted position. For use, the blade is extended out of the wooden handle that contains it by loosening the adjusting means and pushing the adjusting means forward to a desired position. The blade is then clamped securely in its extended position by tightening the adjusting means. When use of the blade is completed, the tool user simply loosens the adjusting means and moves the razor blade back into the wooden handle to a protected position. Tightening the adjusting means when the razor blade is fully retracted will assure that the razor blade is secured in a protected position. The guide means is configured to function as a lid pryer, scraper, and/or screw driver as well as a guide for cutting along the edge of a cardboard box.

An advantage of the present invention is that the cutting blade is mounted in the handle by means of a screw that also secures the handle together and is thus held more secure. Also, the replacement of portions of the tool such as the cutting blade, or the handle of the tool itself, if damaged, is facilitated.

Another advantage of this invention is that the guide means is designed to also function as a screw driver at one end and a scraper or lid pryer at the other end.

Further objects and advantages of this invention will readily be appreciated and more clearly understood by reference to the following detailed description when considered in connection with the accompanying drawing.

DETAILED DESCRIPTION OF THE INVENTION

Figure 1:
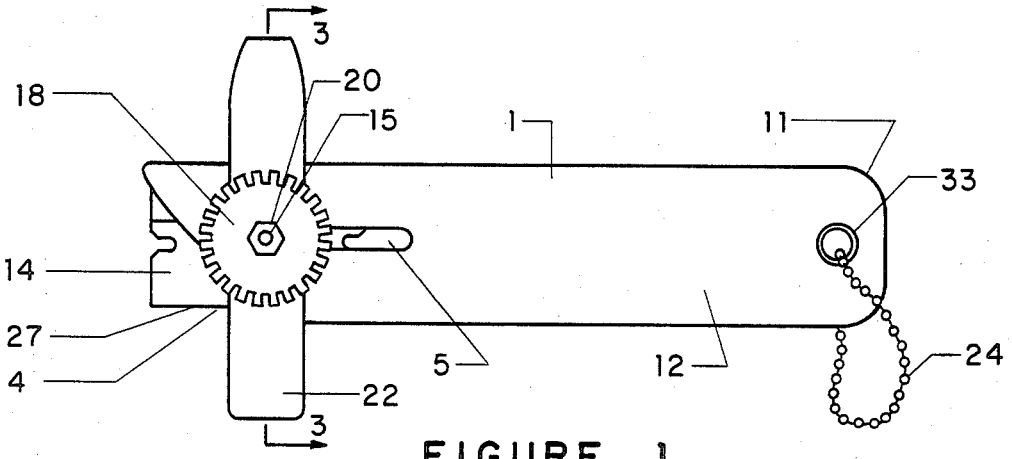
FIG. 1 is a side view of the assembled cutting tool with a razor blade slidably mounted therein.
Figure 2:
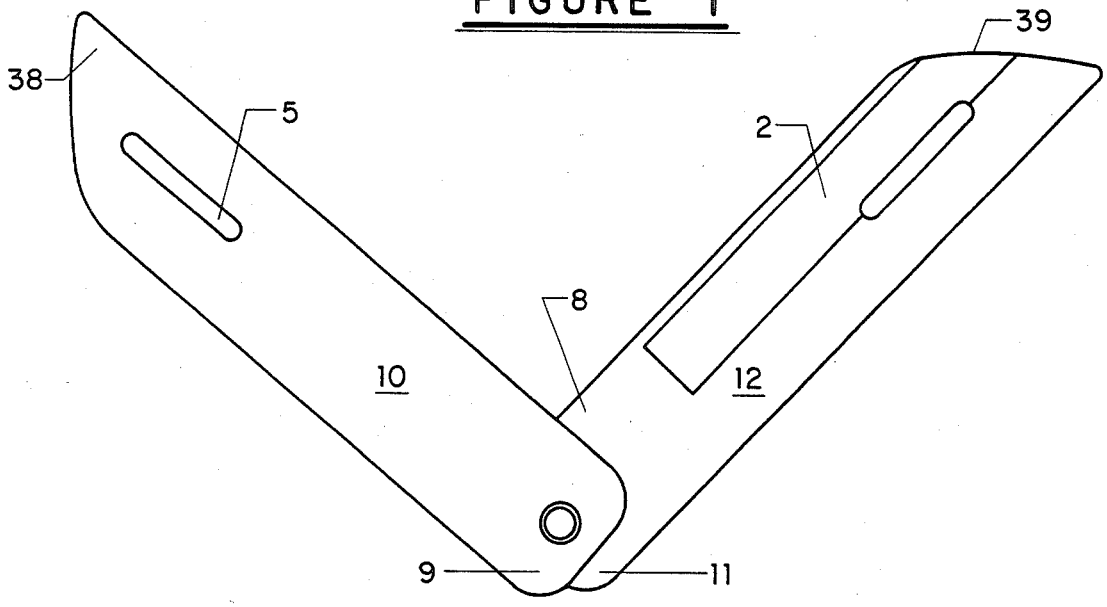
FIG. 2 is a view of the handle of the cutting tool with the razor blade and adjustment mechanism removed and the two sides of the handle separated so as to more clearly show the construction thereof.
Figure 3:
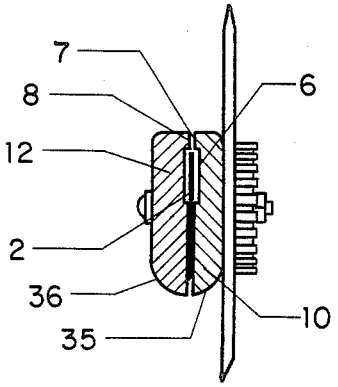
FIG. 3 is a partial cross-sectional view taken along lines 3—3 of the left front of FIG. 1.

FIG. 1 illustrates a cutting tool that includes a handle 1, an adjustment mechanism 4, a single edge razor blade 14, with cutting edge 27 and a carrying chain 24. The handle is composed of two rectangularly shaped symmetrical side members 10 and 12 (FIG. 2). Side members 10 and 12 have, respectively, rounded ends 9 and 11 that are pivotally mounted together by a hollow fastener 33 so that when the side members are aligned flat side 7 of side member 10 is adjacent to an identical flat side 8 on side member 12. Side member 10 has an upper surface 35 that is substantially flat and side member 12 has a similar substantially flat upper surface 36. Ends 38 and 39 of side members 10 and 12 have an arcuate half ogivel shape that suitably exposes the cutting edge 27 of razor blade 14 when the blade is in the cutting position shown in FIG. 1. Elongated adjustment openings 3 and 5 are formed in the side members 10 and 12 and positioned so as to form an adjustment slot when the side members are aligned. Grooves 2 and 6 formed in the side members are positioned so that they form a rectangular recess when the side members are aligned, as shown in FIG. 3. This recess receives the noncutting edge portion of a single edge razor blade slidably mounted between the side members.

Figure 4:
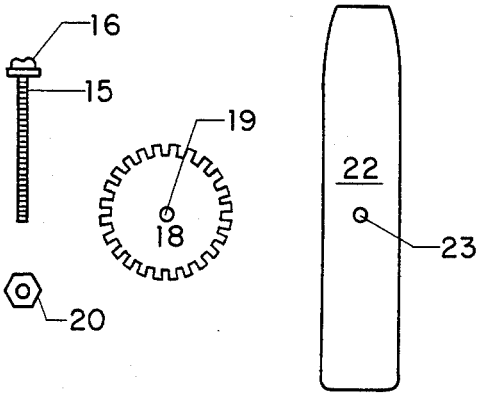
FIG. 4 shows the various components of the adjustment mechanism.

FIG. 4 illustrates the components of the adjustment mechanism employed to clamp the two halves of the handle together during use. The adjustment mechanism includes a through screw 15 adapted to be mounted through the adjustment slot in the handle so that the head 16 thereof is adjacent to the outer substantially flat surface of side member 10. A guide member 22 having a central opening 23 is adapted to be mounted on screw 15 in a position such that guide member 22 abuts the outer flat surface of side member 12. Adjusting washer 18 has a threaded opening 19 in the center thereof so that the washer can be threaded onto screw 15 and exert a clamping force on the two side members when tightened down. locknut 20 can be mounted on screw 15 to lock adjusting washer 18 against rotation. Razor blade 14 shown in FIG. 9 is positioned between the two side members so that screw 15 passes through the razor blade. The noncutting edge of the razor blade 14 is then slidably disposed in the rectangular recess formed by grooves 2 and 6 in the side members 10 and 12.

It is apparent from the foregoing that the blade is extended or retracted by merely loosening the adjustment washer 18 and then sliding all components of the adjustment means, and the razor blade which moves therewith, along the handle so as to extend or retract the razor blade. Tightening of the adjustment washer 18 then securely clamps the razor blade in the selected position. While a preferred embodiment of the invention has been illustrated and disclosed herein, it is apparent that some modification thereto will occur to those skilled in this art without departing from the spirit of the invention.

What is claimed is:

1. A cutting tool for opening cardboard boxes and the like comprising:

handle means that includes first and second symmetrical side members, said first and second side members each having a rounded end, an arcuate half ogival end, and inner and outer flat and parallel side surfaces connected by rounded edge surfaces, said inner side surfaces having a flat surface area larger than said outer side surfaces;

said first and second side members each having a elongated adjustment opening cut therethrough in a position near the ogival ends thereof such that the adjustment openings will be aligned to provide an adjustment slot completely through said handle means when said first and second side members are secured together in an aligned position;

said first and second side members each having a rectangular adjustment groove formed in the inner side surfaces thereof adjacent said adjustment opening, said adjustment grooves extending to the arcuate ends of said first and second side members and being positioned so that when the first and second side members are aligned the adjustment grooves are aligned to provide a recess for the noncutting edge of a single edge razor blade;

hollow fastener means pivotally connecting the rounded ends of said first and second side members together such that the inner flat surfaces thereof are juxtaposed when said first and second side members are aligned;

a single edge razor blade having a positioning hole formed therein, said blade being slidably mounted between said first and second side members so that the cutting edge of said razor blade can be exposed at the arcuate end of said handle means to enclose the cutting edge of the razor blade when the tool is not in use;

adjustment means mounted through the adjustment slot in said handle means and engaging the razor blade for moving the razor blade to a selected position for cutting, or to a blade enclosed position, and securing said first and second side members together with sufficient force to retain the razor blade in the selected position, said adjustment means including a screw mounted through the adjustment slot in said handle means and the positioning hole in said razor blade, said screw being oriented so that the screw head is positioned adjacent to the outer flat surface of said first side member and the threaded end of the screw is adjacent to the outer flat surface of said second side member, and an adjusting washer having a threaded central opening threadably mounted on said screw and positioned adjacent to the outer flat surface of said second side member for clamping the two sides of the handle means together to retain the razor blade in a selected position and a nut threaded on said screw for pressing the adjusting washer against the handle means to retain the razor blade in its selected position; and a rectangularly shaped, thin guide member having a centrally disposed mounting hole rotatably mounted on said screw and positioned between said adjusting washer and the outer flat surface of said second side member, whereby said guide member can be positioned in a guiding position or a nonguiding position, said guide member also functioning as a lid prying device, scraper, and screw driver.

* * * * *